US005448460A

United States Patent [19]

Belfer et al.

[11] Patent Number: 5,448,460

[45] Date of Patent: Sep. 5, 1995

[54] FLUORESCENT LIGHTING FIXTURE HAVING A BENDABLE SUPPORT AND MOUNTING SYSTEM

[75] Inventors: Bruce D. Belfer; Norman Armbrust, both of Ocean, N.J.

[73] Assignee: Lighting World Inc., Ocean, N.J.

[21] Appl. No.: 238,470

[22] Filed: May 5, 1994

[51] Int. Cl.[6] ..... F21S 3/00

[52] U.S. Cl. ..... 362/225; 362/217; 362/250

[58] Field of Search ..... 362/216, 219, 225, 221, 362/223, 224, 238, 239, 240, 250

[56] References Cited

U.S. PATENT DOCUMENTS 3,404,268 10/1968 Fowler ..... 362/250
4,204,273 5/1980 Goldberg ..... 362/219
4,439,818 3/1984 Scheib ..... 362/221
4,607,317 8/1986 Lin ..... 362/223
5,221,139 6/1993 Belfer ..... 362/216

*Primary Examiner*—Carroll B. Dority
*Attorney, Agent, or Firm*—Ezra Sutton

[57] ABSTRACT

A bendable lighting fixture for fluorescent lighting is provided, which includes a plurality of support members, each having a mounting surface for receiving a fluorescent lamp; a socket for receiving a fluorescent lamp mounted on the mounting surface; a connector assembly for pivotally connecting each pair of adjacent support members; and the plurality of support members being movable relative to each other to form the lighting fixture into the desired curved shape.

9 Claims, 7 Drawing Sheets

FLUORESCENT LIGHTING FIXTURE HAVING A BENDABLE SUPPORT AND MOUNTING SYSTEM

FIELD OF THE INVENTION

The present invention relates to a fluorescent lighting fixture that provides a continuous linear, curved, or circular lighting track. The lighting track has a bendable support and mounting system to provide a custom design for any installation.

BACKGROUND OF THE INVENTION

In present lighting fixtures, the fluorescent lamps are usually arranged in a straight line and positioned such that the lighting fixtures are all at the same level. These lighting fixtures cannot normally be shaped to meet special design configurations, curved contours, or custom fit designs and installations.

It is an object of the present invention to provide a fluorescent lighting fixture that can meet all design configurations of any curved, circular, or radial arc shape in any installation, such as a ceiling, contoured cone, or valance.

Another object of the present invention is to provide a fluorescent lighting fixture that can be custom designed in the field, to the desired shape, without the need of specialized tools.

Another object of the present invention is to provide a bendable or adjustable fluorescent lighting fixture that eliminates the need for exact field dimensions and/or engineering design drawings.

A still further object of the present invention is to provide a fluorescent lighting fixture that can be easily packaged and shipped, which minimizes cost, and delivery and scheduling problems.

Still another object of the present invention is to provide a fluorescent lighting fixture with a flexible mounting track that can be made of aluminum, stainless steel, and/or plastic materials.

SUMMARY OF THE INVENTION

In accordance with the principles of the present invention, there is provided a fluorescent lighting fixture having a flexible support and mounting system. The lighting fixture track includes a plurality of support and mounting members, each having a surface wall on which a plurality of lamp sockets is mounted for supporting the fluorescent lamps adjacent to the lamp socket ends. In one embodiment, the support and mounting members are joined by a connector assembly at adjacent ends of the aforementioned support members, which pivotally connects the supporting members in series. This provides the fluorescent lighting fixture with a flexible or bendable mounting and support system for shaping of the lighting track to any desired curved, semi-curved, radial, or circular configuration, in meeting job site specifications for specialized lighting placements.

BRIEF DESCRIPTION OF THE DRAWINGS

Further objects, features, and advantages of the present invention will become apparent upon the consideration of the following detailed description of the presently-preferred embodiment when taken in conjunction with the accompanying drawings, wherein.

DETAILED DESCRIPTION OF THE PREFERRED EMBODIMENT

Figure 1:
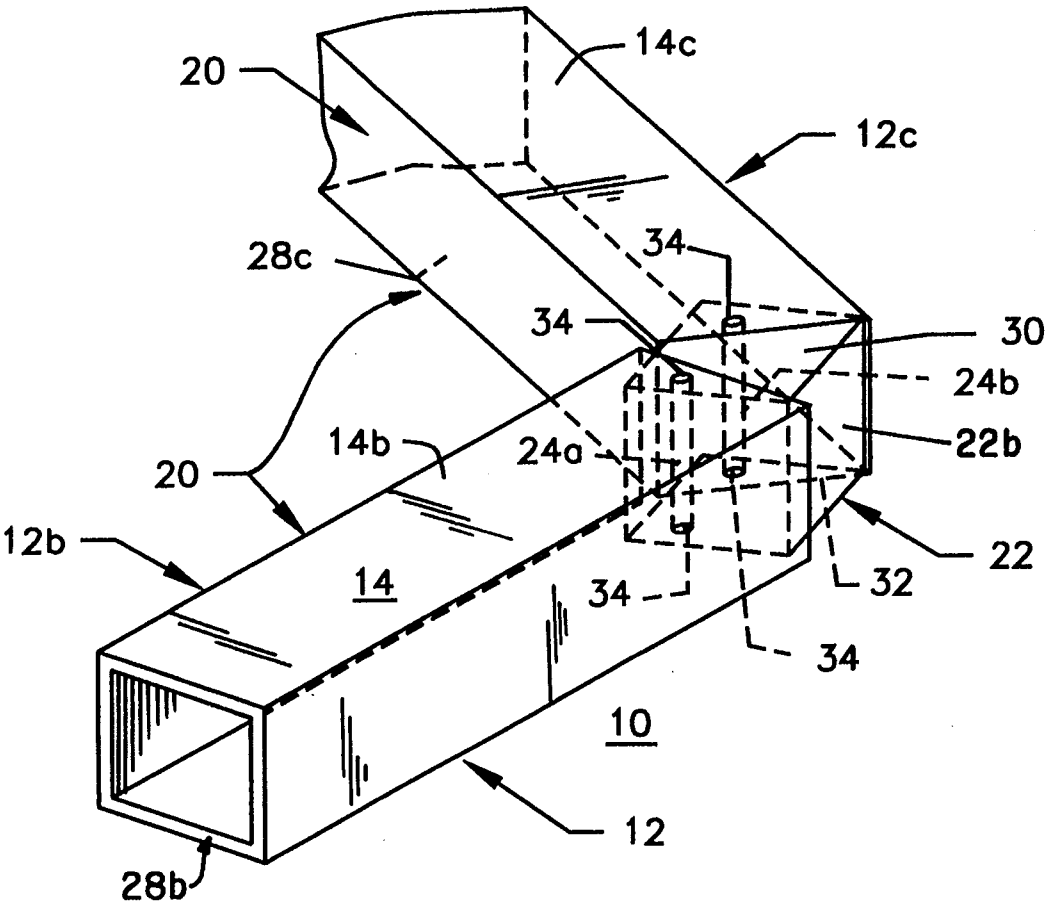
FIG. 1 is a perspective view of the adjustable support and mounting system of the fluorescent lighting fixture of the present invention.
Figures 3, 4:
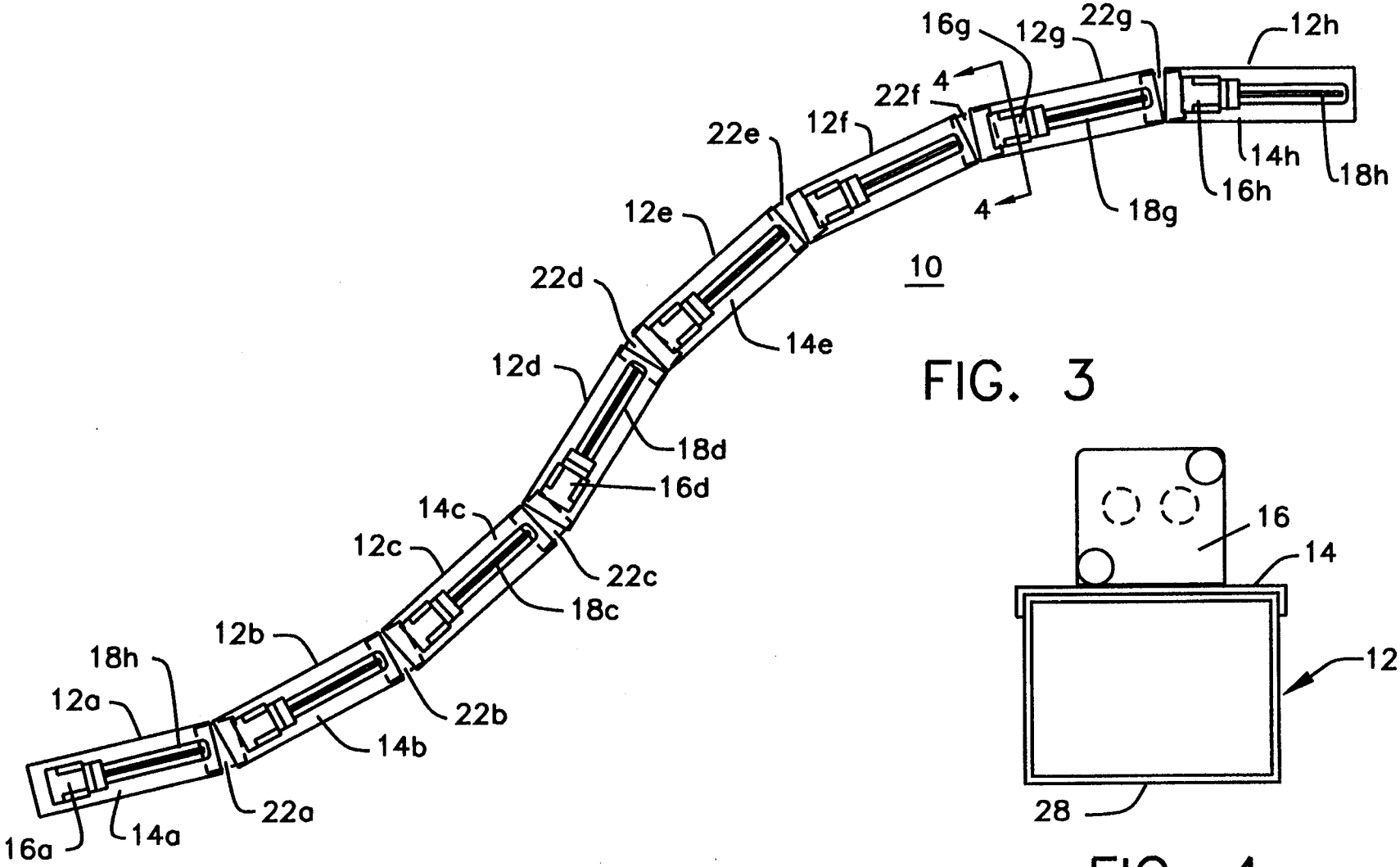
FIG. 3 is a top plan view of the fluorescent lighting fixture of the present invention showing all component parts in detail in a curved shape.
FIG. 4 is a sectional side view taken along lines 4—4 of FIG. 3 showing the support member and socket component.

As shown in detail in FIGS. 1 and 3 of the present invention, the fluorescent lighting fixture 10 includes a support and mounting member 12 having a plurality of support sections **12*a* to 12*h*, each having an upper surface or wall 14*a* to 14*h*. Lamp sockets 16*a* to 16*h* are mounted on one end of each of the upper surfaces 14*a* to 14*h*. Attached to each lamp socket 16*a* to 16*h* is a fluorescent lamp 18*a* to 18*h***.

The plurality of support and mounting sections **12*a* to 12*h* is connected in series to form the fluorescent lighting fixture track 20, wherein each pair of adjacent support members 12 is joined together by a connector assembly 22**.

Figure 2:
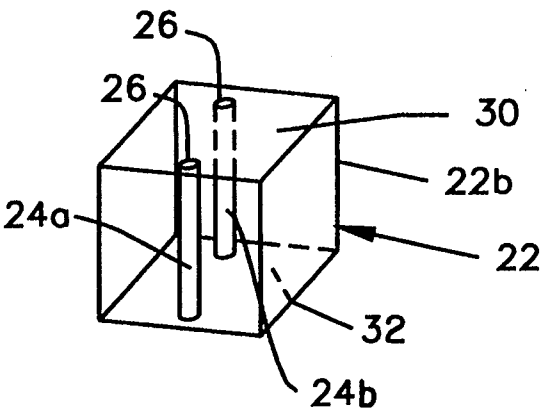
FIG. 2 is a perspective view of the connector assembly of the support and mounting system of the present invention.

As shown in detail in FIGS. 1 and 2, each connector assembly 22 has a left and right hinge pin **24*a* and 24*b* that are hingedly or pivotally connected to hole openings 26 formed in the upper and lower surface walls 30 and 32 of the connector assembly 22, respectively. The hinge pins 24*a* and 24*b* of each connector assembly 22 are also pivotally attached to the adjacent ends of each support member 12 at hole openings 34. However, the first and last support members 12 of lighting fixture track 20 has the connector assembly 22 attached only to one of the ends of support member 12**.

The series of pivotally connected support members 12 and connector assemblies 22 form the bendable lighting fixture track 20, which can be adjusted to form a curved track 20 of lighting fixtures, as shown in detail in FIG. 3. The support members 12 and connector assemblies 22 can be made of any suitable materials, such as aluminum, stainless steel, or plastic.

Figure 5:
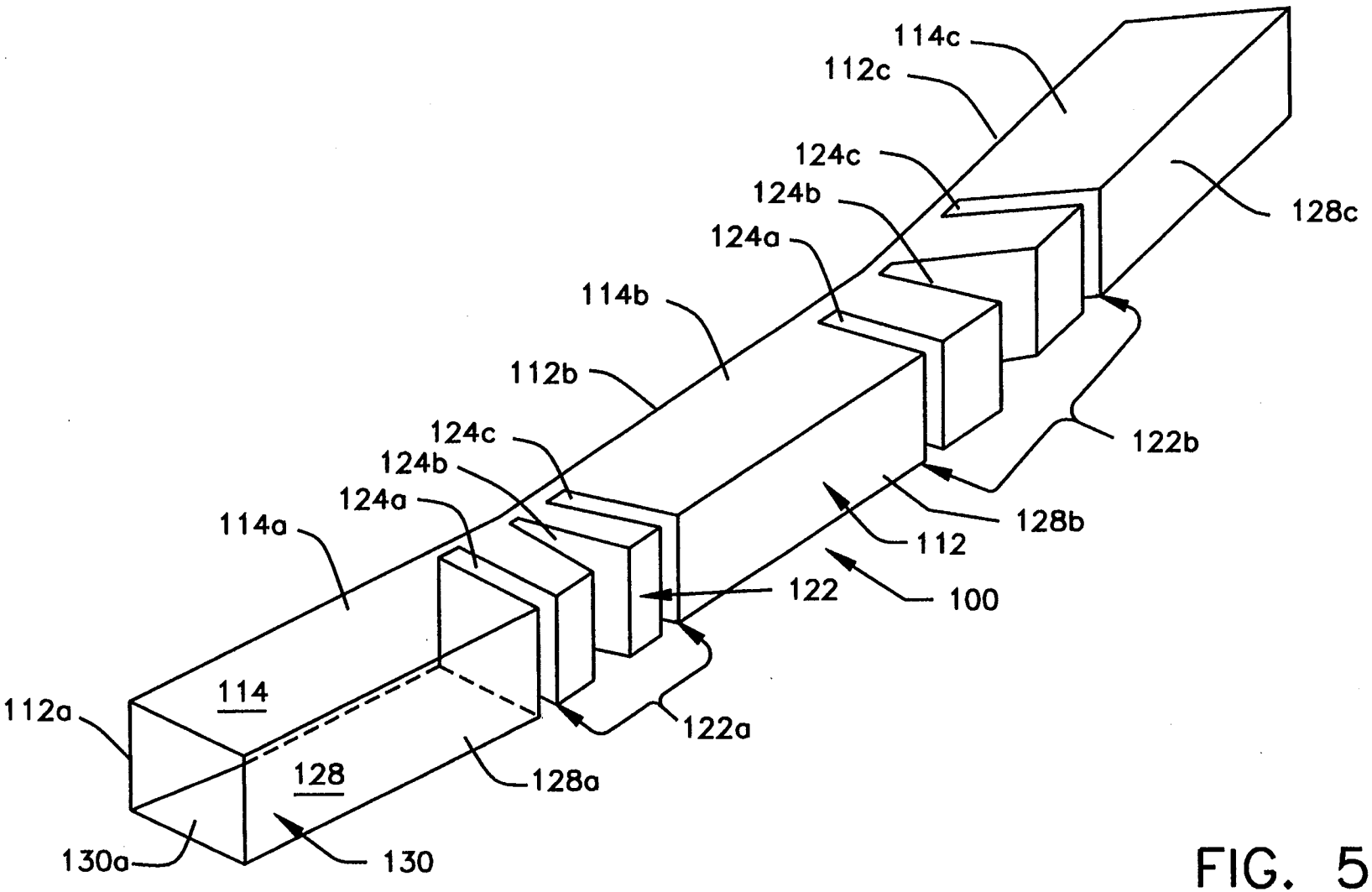
FIG. 5 is a perspective view of a second embodiment of a bendable support and mounting system of a fluorescent lighting fixture for the present invention.
Figure 6:
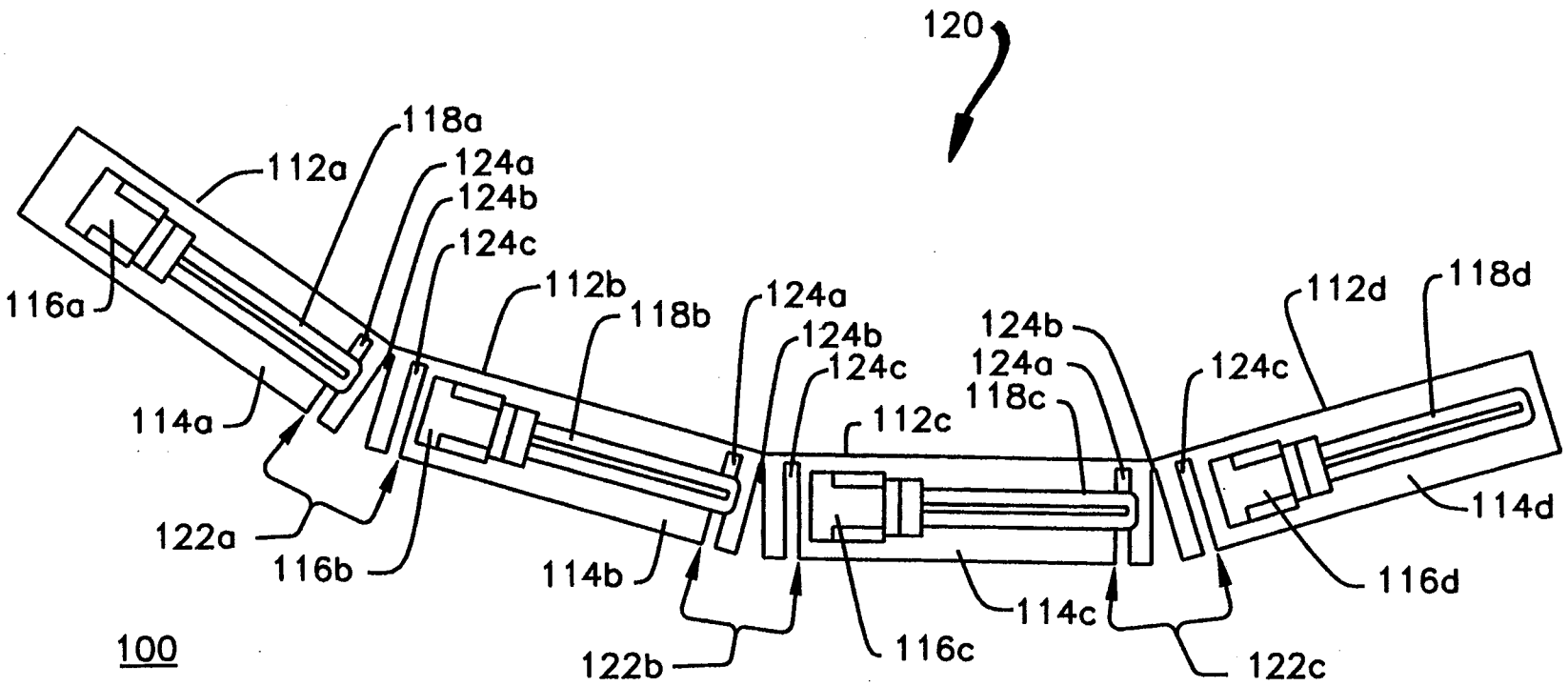
FIG. 6 is a top plan view of the fluorescent lighting fixture of the present invention showing the second embodiment in detail and in a curved shape.

The present invention also includes as a second embodiment, an alternative lighting fixture 100, as shown in detail in FIGS. 5 and 6. The fluorescent lighting fixture 100 includes a support member 112 having a plurality of sections **112*a* to 112*c*, each section having an upper surface or wall 114*a* to 114*c*, a side surface or wall 128*a* to 128*c*, and a bottom surface or wall 130*a* to 130*c*. Lamp sockets 116*a* to 116*c* are attached to each of the upper surfaces 114***a* to 114*c* or to sidewall surfaces 128*a* to 128*c* of the support member 112. Attached to each lamp socket 116*a* to 116*c* is a fluorescent lamp 118*a* to 118*c*.

As shown in FIG. 6, the plurality of support members 112*a* to 112*d* are connected in series to form a lighting fixture track 120. Each pair of support members 112 is physically joined in a continuous and integral manner, and the support member 112 is made bendable by curfing 122, as shown in detail by FIG. 5. Curfing 122 is performed by the forming of three (or more) slots 124*a*, 124*b*, and 124*c* through the three surface walls 114, 128, and 130 of each support member 112. As a result, support members 112 can bend relative to each other, to form a curved track 120 of lighting fixture 100, as shown in detail in FIG. 5 and 6. The support members 112 can be made of suitable materials, such as aluminum, stainless steel, or plastic.

Figure 7:
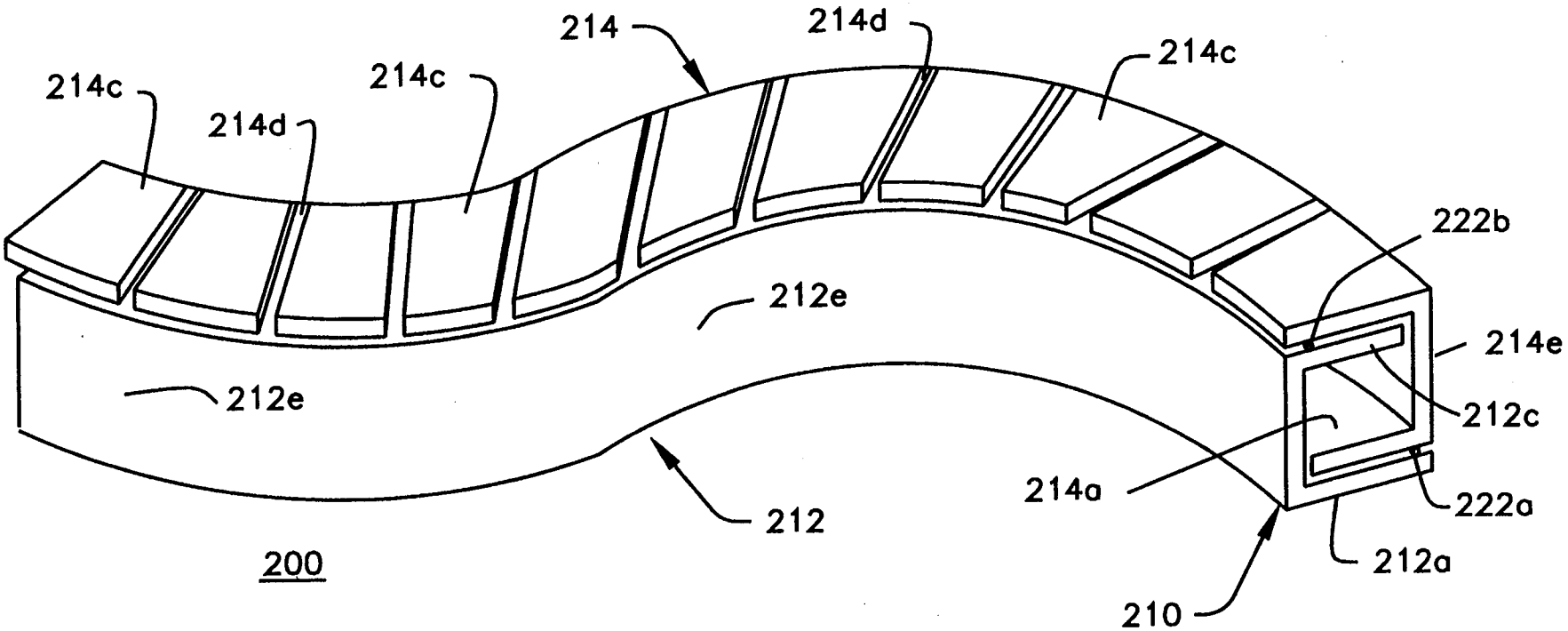
FIG. 7 is a perspective view of a third embodiment of a bendable support and mounting system for a fluorescent lighting fixture.
Figure 8:
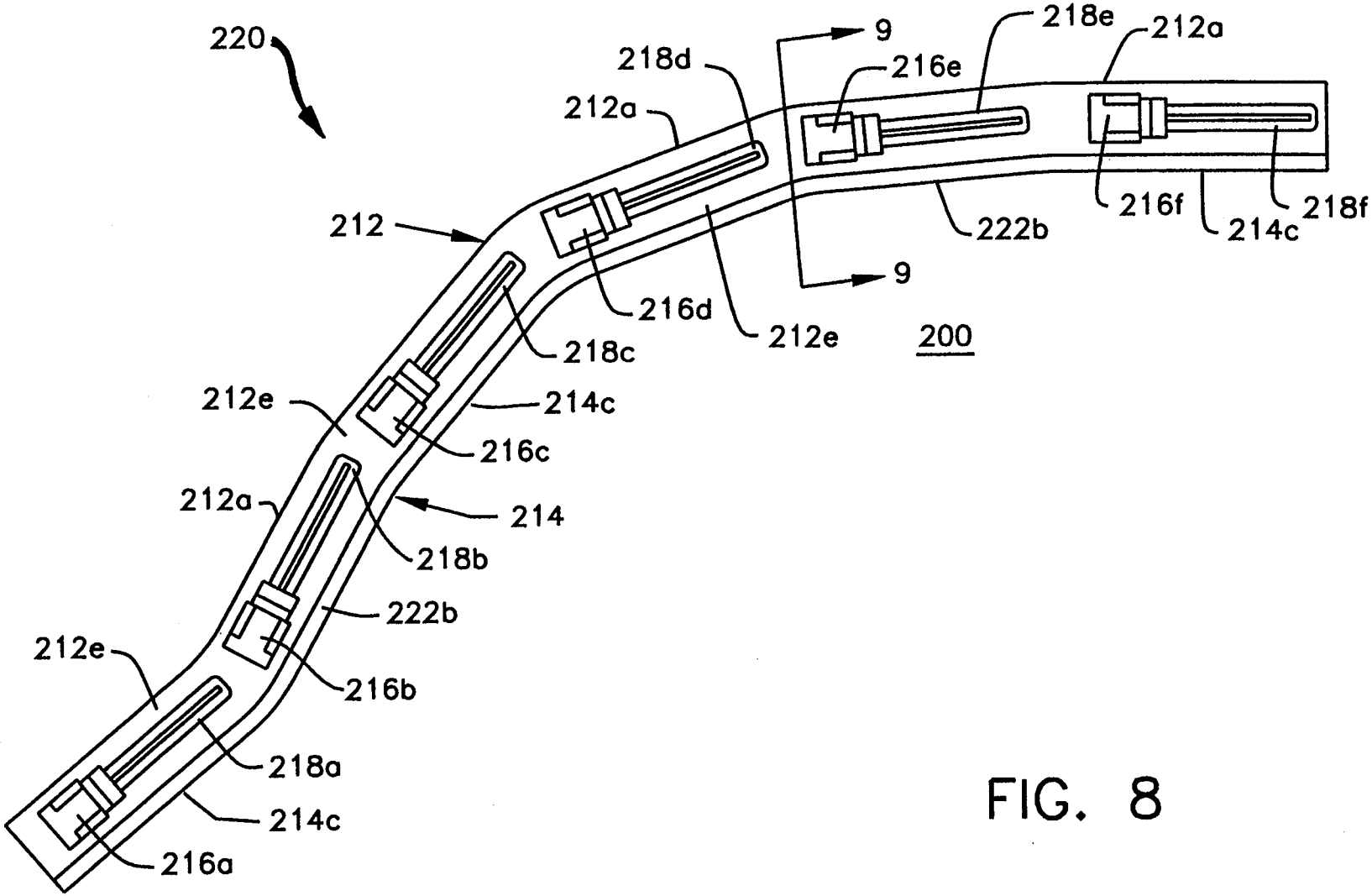
FIG. 8 is a top plan view of the fluorescent lighting fixture of the present invention showing the third embodiment in detail and in a curved shape.
Figure 9:
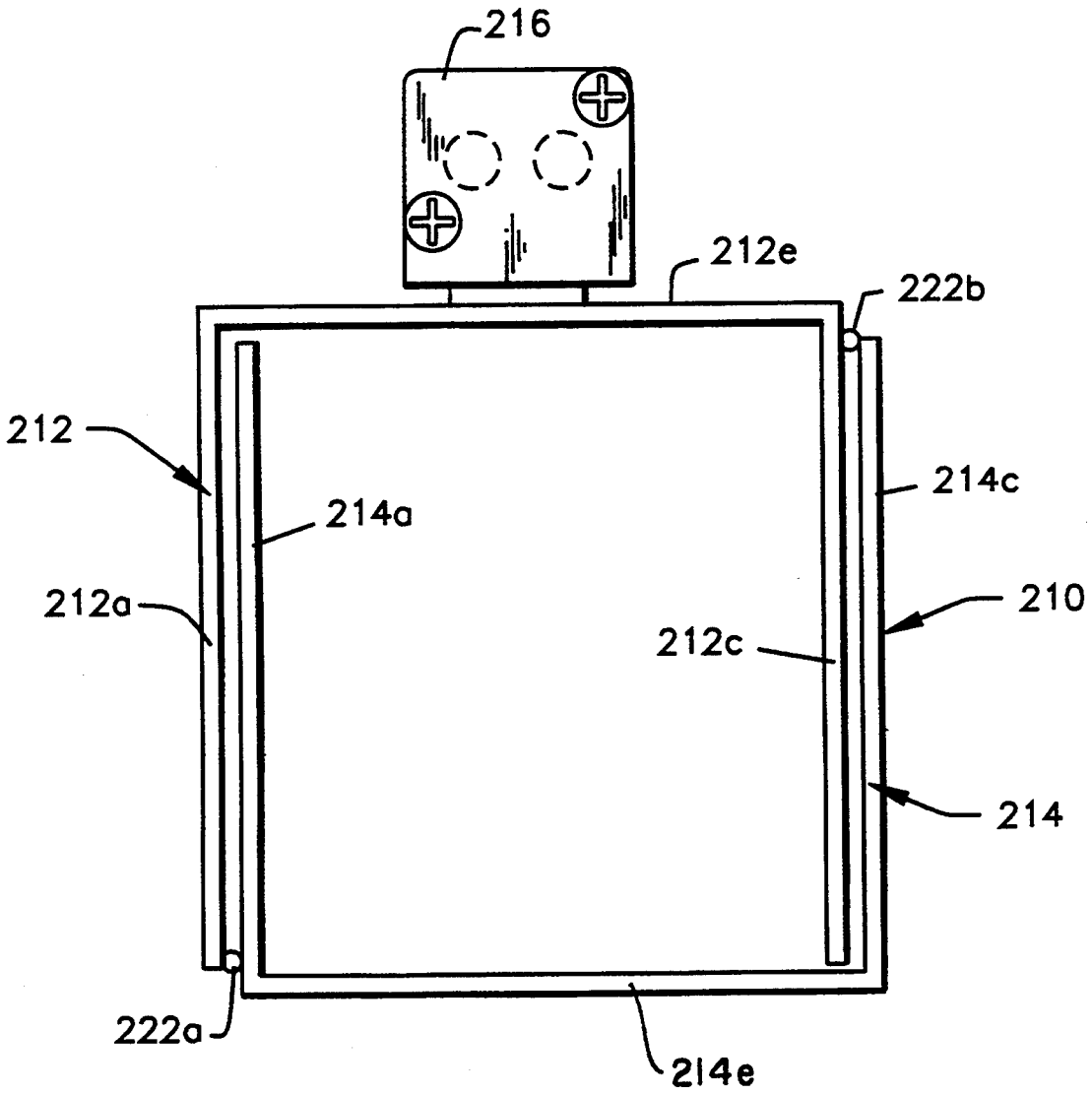
FIG. 9 is a sectional side view taken along lines 9—9 showing the support member and socket component.

The present invention also includes as a third embodiment, an alternative lighting fixture 200, as shown in detail in FIGS. 7, 8, and 9. The fluorescent lighting fixture 200 includes a support and mounting system 210 made up of two interlocking U-shaped channels 212 and 214. U-shaped channel 212 includes a plurality of left side wall sections 212*a* having slots 212*b* between the wall sections 212*a*, a plurality of right side wall sections 212*c* having slots 212*d* between the wall sections 212*c*, and a mounting surface 212*e*. The other U-shaped channel 214 includes a plurality of left side wall sections 214*a* having slots 214*b* between the wall sections 214*a*, a plurality of right side wall sections 214*c* having slots 214*d* between the wall sections 214*c*, and a mounting surface 214*e*. Two longitudinal beads 222*a* and 222*b* interconnect the two interlocking U-shaped channels 212 and 214. Bead 222*a* is located between channel walls 212*a* and 214*a*, and bead 222*b* is located between channel walls 212*c* and 214*c*, as shown in detail by FIG. 9. Lamp sockets 216*a* to 216*f* may be attached to either mounting surface 212*e* or 214*e*. Attached to each lamp socket 216*a* to 216*f* is a fluorescent lamp 218*a* to 218*f*, respectively. The plurality of wall sections 212*a*, 212*c*, 214*a*, and 214*c* are integrally connected to mounting surfaces 212*e* and 214*e*, respectively, and form a lighting fixture track 220 of a predetermined length.

As a result, channel members 212 and 214 of the support and mounting system 210 can bend relative to each other, to form a curved track 220 of lighting fixture 200, as shown in detail in FIGS. 8 and 9. The support and mounting system 210 can be made of any suitable materials, such as aluminum, stainless steel, or plastic.

OPERATION OF THE PRESENT INVENTION

The lighting fixture tracks 20, 120, and 220 are shipped to the user in long tubular and/or rectangular-type shipping containers, where the aforementioned tracks 20, 120, and 220 are in a straight modular configuration. The length of the lighting fixture tracks 20, 120, and 220 can be customized to meet the exact length requirements, as specified by the user.

When the lighting tracks 20, 120, and 220 are at the job site, they can be manipulated into any design configuration while in the field without the need of any specially-designed tools. The lighting tracks 20, 120, and 220 will fit the curved contour of a specific project application without the need for exact field dimensions, or the need to have any specially-designed template beforehand.

ADVANTAGES OF THE PRESENT INVENTION

The primary advantage of the present invention is that lighting fixture tracks 20, 120, and 220 have a plurality of bendable or adjustable support members 12, 112 and 210 which meet all design configuration criteria of any special curved, semi-curved, circular, or radial arc shapes to be placed in any installation, such as a ceiling, contoured cone, wall, or valance.

Another advantage of the present invention is that the lighting fixture tracks 20, 120, and 220 can be curved into shape in the field without special tools, eliminating the need for exact field dimensions and minimizing delivery schedule problems. In using this type of plurality of adjustable support members 12, 112, and 210, it is the ultimate solution for problems involving "as specified" versus "as built" radius measurements.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A lighting fixture for fluorescent lighting, comprising:

a) a plurality of support members, each having a mounting surface for receiving a fluorescent lamp;

b) a socket for receiving a fluorescent lamp mounted on said mounting surface;

c) a connector assembly for connecting each pair of adjacent support members, said connector assembly being pivotally connected to said pair of adjacent support members; and d) said plurality of support members being movable relative to each other to form the lighting fixture into the desired shape.

2. A lighting fixture in accordance with claim 1, wherein said connector assembly includes a pair of hinge pins and wherein each of said hinge pins pivotally connects said connector assembly to a support member.

3. A lighting fixture in accordance with claim 2, wherein each of said support members has an opening at each end thereof for receiving therein said connector assembly to nest within said opening.

4. A lighting fixture in accordance with claim 2, wherein each of said support members are hollow for receiving therein at least one of said connector assemblies.

5. A lighting fixture for fluorescent lighting, comprising:

a) a continuous support member having a mounting surface for receiving a plurality of fluorescent lamps;

b) a plurality of sockets for receiving a plurality of fluorescent lamps mounted on said mounting surface; and c) said continuous support member having a plurality of slots formed therein to form a plurality of bendable sections, so that adjacent sections are bendable relative to each other to form the lighting fixture into the desired shape.

6. A lighting fixture in accordance with claim 5, wherein said support member has a plurality of surfaces and wherein said plurality of slots are all on the same surfaces.

7. A lighting fixture in accordance with claim 5, wherein said support member has a plurality of surfaces and wherein said plurality of slots are on opposite surfaces of said support member.

8. A lighting fixture for fluorescent lighting, comprising:

a) a continuous support member including two interlocking U-shaped channel members having a mounting surface for receiving a plurality of fluorescent lamps;

b) a plurality of sockets for receiving a plurality of fluorescent lamps mounted on said mounting surface; and c) each of said U-shaped channel members having a plurality of slots formed therein to form a plurality of bendable sections, so that adjacent sections are bendable relative to each other to form the lighting fixture into the desired shape.

9. A lighting fixture in accordance with claim 8, wherein each of said U-shaped channel members includes two parallel side walls, and said slots are formed in said side walls.

* * * * *